US005347923A

United States Patent [19]

Villiger

[11] Patent Number: 5,347,923

[45] Date of Patent: Sep. 20, 1994

[54] APPARATUS FOR COLLAPSING CONTAINERS

[76] Inventor: Paul Villiger, Bahnhofstrasse 13, CH-5647 Oberrüti, Switzerland

[21] Appl. No.: 96,680

[22] Filed: Jul. 23, 1993

[30] Foreign Application Priority Data

Aug. 13, 1992 [CH] Switzerland ..... 2531/92-7

[51] Int. Cl.[5] ..... B30B 9/32; B30B 1/02

[52] U.S. Cl. ..... 100/137; 100/233; 100/283; 100/291; 100/293; 100/902

[58] Field of Search ..... 100/137, 233, 236, 280, 100/281, 283, 291, 293, 902

[56] References Cited

U.S. PATENT DOCUMENTS

| | | | |
|---|---|---|---|
| 3,667,386 | 6/1972 | Workman | 100/902 X |
| 3,766,849 | 10/1973 | Maron | 100/902 X |
| 4,333,397 | 6/1982 | Modes | 100/902 X |
| 4,475,449 | 10/1984 | Gianelo | 100/902 X |
| 4,561,351 | 12/1985 | Ader | 100/293 X |
| 4,884,502 | 12/1989 | Stacey, Jr. | 100/233 |
| 4,976,196 | 12/1990 | Phillips et al. | 100/233 |

FOREIGN PATENT DOCUMENTS

| | | | |
|---|---|---|---|
| 1394107 | 2/1965 | France | 100/233 |
| 60-82300 | 5/1985 | Japan | 100/902 |

*Primary Examiner*—Stephen F. Gerrity

*Attorney, Agent, or Firm*—Darby & Darby

[57] ABSTRACT

An apparatus for crushing empty cans has a U-shaped support with a bottom wall which supports the tubular wall of an empty can and two upstanding sidewalls. The sidewalls pivotably support the free end portions of two legs forming part of a yoke having a web which constitutes a handle. The legs support a first crushing section in the form of a plate which is located between the sidewalls of the support and defines with the bottom wall a compartment for an empty can which is received in the compartment in such orientation that one of its end walls or its single end wall is adjacent the plate. The plate pivotably supports a second crushing section in the form of a single flap or two links which can engage the tubular wall of a can in the compartment. When the yoke is pivoted from a starting position, the second crushing section provides the tubular wall of the can in the compartment with a transverse fold line and thereupon moves out of the way while the plate pivots the can about the fold line to move one end wall or the only end wall of the can over the previously folded and collapsed tubular wall. The handle is then pivoted to return the plate and the flap to their starting positions and the crushed can is ready to be evacuated from the compartment by gravity or in response to insertion of a fresh empty can.

10 Claims, 3 Drawing Sheets

APPARATUS FOR COLLAPSING CONTAINERS

BACKGROUND OF THE INVENTION

The invention relates to improvements in apparatus for collapsing containers, particularly for crushing empty or partly empty cans. Still more particularly, the invention relates to improvements in apparatus for crushing metallic and/or plastic cans between stationary and mobile crushing units.

A drawback of presently known can crushing apparatus is that the crushing or collapsing of a can necessitates the application of a considerable force. On the other hand, if the power train between the handle and the mobile crushing unit employs a step-down transmission, this entails a pronounced lengthening of the required interval of time and/or a movement of the handle through a considerable distance.

OBJECTS OF THE INVENTION

An object of the invention is to provide a simple, compact and inexpensive apparatus which can be used for the crushing of empty containers with the exertion of a small force.

Another object of the invention is to provide an apparatus which can crush a can within a short interval of time.

A further object of the invention is to provide an apparatus which can be readily manipulated by unskilled as well as by elderly, infirm and/or handicapped persons.

An additional object of the invention is provide an apparatus which can be readily manipulated by one hand.

Still another object of the invention is to provide the above outlined apparatus with novel and improved can engaging, locating and crushing components.

A further object of the invention is to provide the apparatus with novel and improved means for guiding the mobile components along predetermined paths.

Another object of the invention is to provide a novel and improved method of collapsing empty or partly emptied soda cans, beer cans, fruit cans, vegetable-containing cans and/or other collapsible containers of metallic or plastic material.

SUMMARY OF THE INVENTION

The invention is embodied in an apparatus for crushing containers, e.g., in the form of cans made of sheet metal or a plastic material. The improved apparatus comprises a container-supporting first crushing unit and a second crushing unit which is movable with reference to the first unit from a starting position in which the units define a compartment for a container to be crushed. The second crushing unit comprises a first section which is engageable with a first portion (e.g., a tubular wall) of a container in the compartment and a second section which is engageable with a second portion of the container in the compartment (e.g., with one end wall of an empty container). The apparatus further comprises means for moving the second unit from and back to the starting position, and means for guiding the first and second sections for movement along first and second paths, respectively, in response to movement of the second crushing unit from the starting position to thereby deform the first and second portions of the container in the compartment.

The first path can be configurated in such a way that it causes the first section of the second crushing unit to impart to the first portion of the container in the compartment a fold line for pivoting of the second portion of the container in the compartment along the fold line and over the first portion in response to movement of the second section of the second crushing unit along the second path.

The first crushing unit can include a bottom wall which is disposed adjacent and beneath the compartment, and the two sections of the second crushing unit are then disposed above the bottom wall and move toward the bottom wall in response to movement of the second crushing unit from the starting position.

If the apparatus is designed to crush or collapse empty tubular containers of the type having a cylindrical or polygonal tubular peripheral wall constituting the first portion and an end wall constituting the second portion of the container, the upper side of the bottom wall of the first crushing unit preferably serves to support the peripheral wall of a container in the compartment. The moving means of such apparatus can comprise a device which serves to move the second section of the second crushing unit during a first stage of movement of the second crushing unit from the starting position and to move the first section of the second crushing unit during a second stage of movement of the second crushing unit from the starting position not later than during the first stage.

The arrangement is preferably such that the first section of the second crushing unit moves along a first portion of the first path in a direction toward the bottom wall of the first crushing unit and that such first section moves away from the second path during movement along a second portion of the first path. The first section of the second crushing unit first moves toward the bottom wall (i.e., along the first portion of the first path) and thereafter moves along the second portion of the first path (away from the second path) in response to movement of the second crushing unit from the starting position.

The moving means can comprise a carrier (e.g., a substantially U-shaped yoke) and means (e.g., a single shaft or two axially spaced apart shafts) for pivotably connecting the carrier to the support. At least one section of the second crushing unit can be mounted directly on the carrier.

In accordance with a presently preferred embodiment, the first path includes a portion wherein the first section of the second crushing unit is moved to provide the first portion of a container in the compartment with a fold line, and a second portion wherein the first section of the second crushing unit is moved away from the thus obtained fold line to thereby provide room for pivoting of the second portion of the container in the compartment over the first portion of such container along the fold line in response to movement of the second section of the second crushing unit along the second path.

In addition to the aforementioned bottom wall, the first crushing unit can further comprise two upstanding sidewalls which flank the compartment for a container to be crushed. The moving means of such apparatus can comprise a substantially U-shaped carrier or yoke having a web which is remote from the compartment and two legs having free end portions remote from the web and each pivotably mounted in a different one of the two sidewalls. The web can constitute a handle or handgrip portion of the moving means.

The second section of the second crushing unit can comprise a plate and the moving means preferably comprises means for pivoting the plate relative to the first crushing unit. The first section of such second crushing unit can comprise a flap and a hinge which connects the flap to the plate. Alternatively, the second section of the second crushing unit can comprise first and second links and hinges which movably connect the links to the plate. The handle is preferably pivotable about a substantially horizontal axis when the apparatus is in use, and the two links are or can be mirror images of each other with reference to a plane which is normal to the pivot axis for the handle and is located between the two links. Means can be provided for movably connecting the first and second links to the first crushing unit, and such connecting means can comprise guides on the first crushing unit, an additional link for each of the first and second links, a hinge connecting each additional link to the respective one of the first and second links, and a universal joint which connects each additional link with the first unit.

One of the two sections of the second crushing unit is preferably designed to movably support and to transmit motion to the other section in response to movement of the second crushing unit to and from the starting position.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain presently preferred specific embodiments with reference to the accompanying drawings.

DESCRIPTION OF PREFERRED EMBODIMENTS

Figure 2:
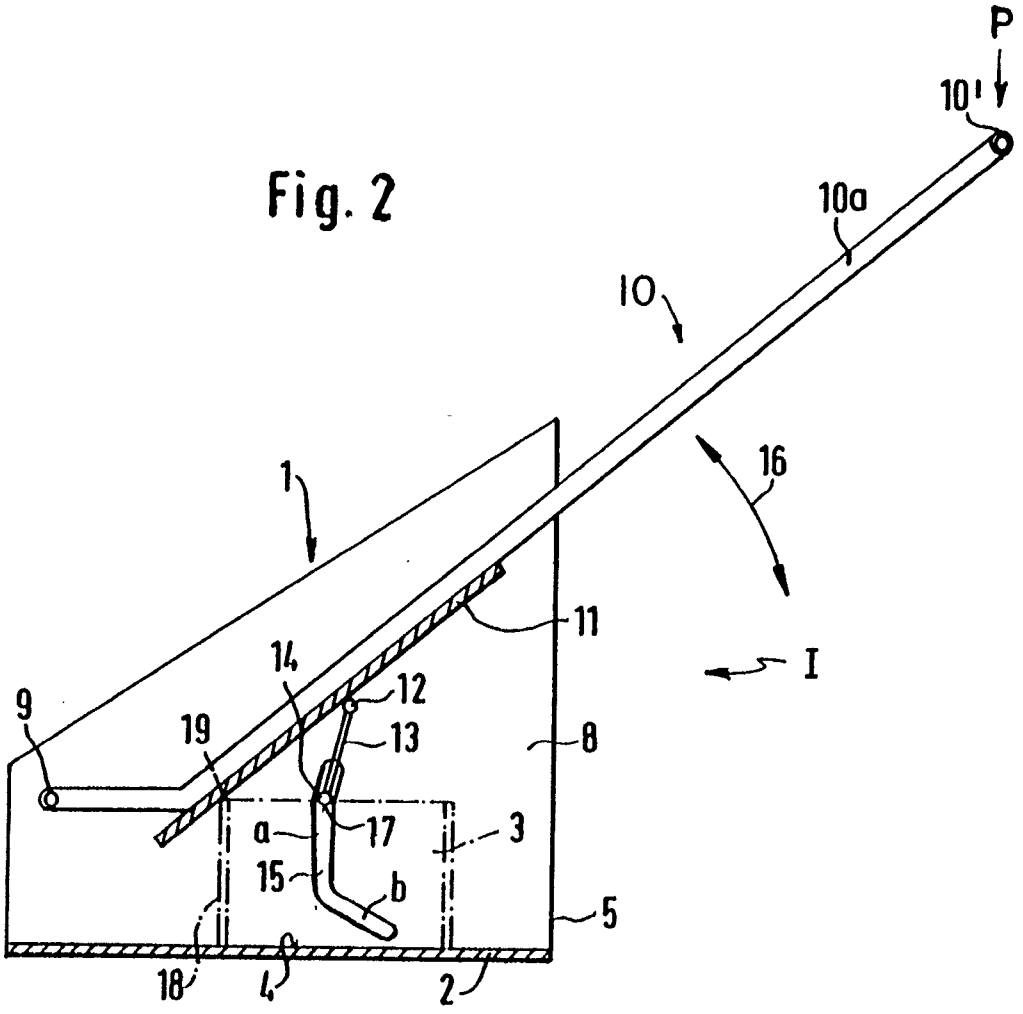
FIG. 2 is a sectional view substantially as seen in the direction of arrows from the line II—II in FIG. 1.
Figure 1:
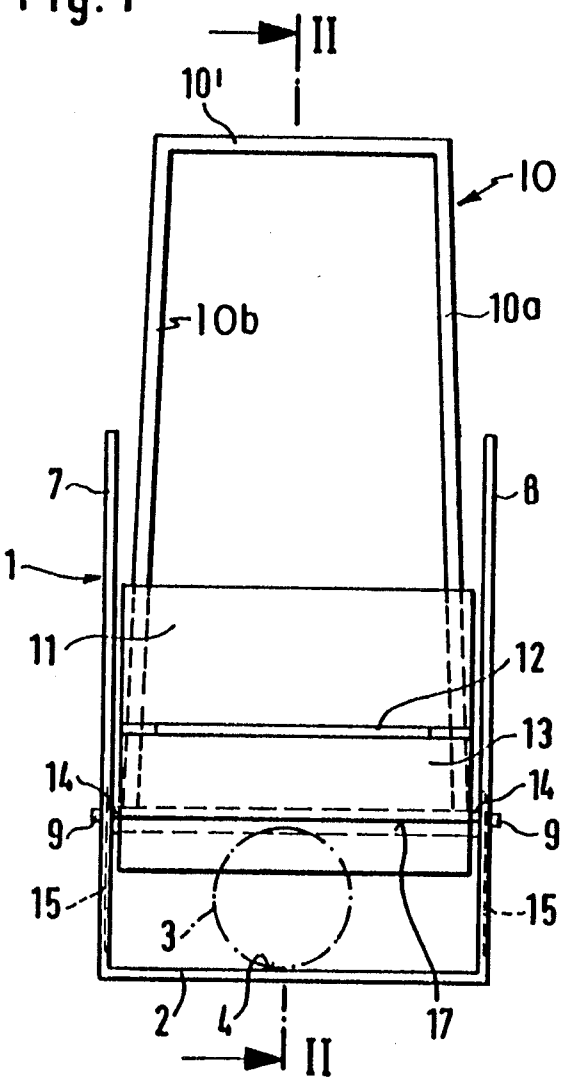
FIG. 1 is a somewhat schematic end elevational view of a crushing apparatus which embodies one form of the invention, the view being taken in the direction of arrow I in FIG. 2 and the means for moving the second crushing unit being shown in the starting position, and further showing a can in the compartment between the bottom wall of the first crushing unit and the two sections of the second crushing unit.

Referring first to FIGS. 1 and 2, there is shown an apparatus which can be utilized as a means for collapsing or crushing empty or partly emptied containers 3 (one indicated by phantom lines), e.g., beer cans, soda cans or like containers (hereinafter called cans for short) of the type having one or two end walls 18 and a tubular (cylindrical, polygonal or oval) peripheral wall 19*a*.

The improved apparatus comprises a first crushing unit 1 here shown as a substantially U-shaped support having a plate-like bottom wall 2 and two upstanding sidewalls 7, 8 flanking a suitably dimensioned and configurated compartment 4 above the upper side of the bottom wall 2. The compartment 4 is or can be dimensioned to receive one can 3 at a time, preferably in such orientation that the end wall 18 confronts an outlet 6 and that the peripheral wall 19*a* is nearer an inlet 5 of the first crushing unit 1. The latter can be made of a suitable metallic material and is sufficiently rigid to withstand the deforming stresses which develop during preferably multiple-stage crushing of a can 3 in the compartment 4. A can 3 which has been properly inserted into the compartment 4 can have an open side confronting the inlet 5 of the elongated space or channel extending above the upper side of the bottom wall 2 and between the inner sides of the sidewalls 7, 8. If the peripheral wall 19*a* of the can 3 in the compartment 4 is a cylinder, the external surface of such peripheral wall is in substantially linear contact with the upper side of the bottom wall 2, and the line of contact extends longitudinally of the bottom wall from the inlet 5 toward the outlet 6. If desired, the orientation of a can 3 in the compartment 4 can be even more predictable by providing the upper side of the bottom wall 2 with a longitudinally extending recess or groove (not shown) substantially midway between the sidewalls 7 and 8.

When the improved apparatus is to be put to actual use, it can be placed onto a floor or the like in such orientation that the upper side of the bottom wall 2 slopes downwardly in a direction from the inlet 5 toward the outlet 6; this ensures that a can 3 which is to be crushed automatically slides along the upper side of the bottom wall 2 until its front end wall 18 reaches a stop 19, namely a portion of the underside of a plate-like (second) section 11 of a composite second crushing unit which is movably mounted on the sidewalls 7, 8 of the first crushing unit or support 1. The inclination of the upper side of the bottom wall 2 can be selected in such a way that a can 3 which has been introduced into the first crushing unit 1 through the inlet 5 slides forwardly and downwardly (e.g., in the aforementioned centrally located groove between the sidewalls 7, 8) to advance toward and to be automatically arrested by the portion 19 of the underside of the plate 11 which is then maintained in the starting position shown in FIGS. 1 and 2, namely at a maximum distance from the upper side of the bottom wall 2. An advantage of positioning the first crushing unit 1 in such orientation that the upper side of the bottom wall 2 slopes downwardly from the inlet 5 toward the outlet 6 is that a freshly collapsed or crushed can 3′ (FIG. 2*b*) can automatically slide forwardly into and beyond the outlet 6 (to descend into a properly positioned collecting receptacle or onto the upper reach of a belt conveyor or the like, not shown) as soon as the plate 11 is returned from the lower end position of FIG. 2*b* to the starting position of FIGS. 1 and 2. On the other hand, positioning of the first crushing unit 1 in such orientation that the upper side of the bottom wall 2 is at least nearly horizontal exhibits the advantage that a freshly crushed can 3′ can be expelled forwardly through the outlet 6 (e.g., in response to insertion into the compartment 4 of a next can 3 to be crushed) or rearwardly, i.e., through the inlet 5.

Exact positioning of a can 3 to be crushed midway between the sidewalls 7, 8 (so that its axis is located in a central vertical symmetry plane between the two sidewalls) is desirable but not critical. Furthermore, the crushing operation can proceed and can be completed even though a can which is about to be crushed does not actually abut the underside of the plate 11 while the latter is held in the starting position of FIGS. 1 and 2. At least substantial centering of a can 3 to be crushed in the compartment 4 between the sidewalls 7, 8 is enhanced or ensured by providing the upper side of the bottom wall 2 with the aforediscussed longitudinally extending recess or groove.

The means for moving the plate 11 and another (first) section 13 of the second crushing unit to and from the starting positions shown in FIGS. 1 and 2 comprises a substantially U-shaped yoke 10 having a relatively short web or handle 10' remote from the compartment 4 and two elongated parallel legs 10*a*, 10*b*. The free end portion of the leg 10*a* is pivotably mounted in the sidewall 8 by a first short horizontal shaft 9, and the free end portion of the leg 10*b* is pivotably mounted in the sidewall 7 by a second short horizontal shaft 9. The shafts 9 define a common horizontal pivot axis for the moving means or yoke 10. The two discrete shafts 9 can be replaced with a single shaft which extends all the way across the space between the sidewalls 7, 8 of the first crushing unit 1.

The plate 11 is fixedly secured to the undersides of those portions of the legs 10*a*, 10*b* which are adjacent the shaft or shafts 9. The shaft or shafts 9 can be said to constitute a means for guiding the plate 11 in response to pivoting of the legs 10*a*, 10*b* by the handle or web 10' in either of the two directions indicated by a double-headed arrow 16.

The other (first) section 13 of the second crushing unit is a flap which is movably connected to the underside of the plate 11 by a horizontal hinge 12 extending in parallelism with the shaft or shafts 9. The means for guiding the section or flap 13 (hereinafter called flap for short) in response to pivoting of the yoke 10 by the handle 10' (either to or from the starting position of FIGS. 1 and 2 comprises two elongated cams 15 (e.g., groove cams) which are mirror images of each other and are provided in the lower portions of the sidewalls 7 and 8. A rounded lower marginal portion 17 of the flap 13 has two ends 14 constituting followers which track the respective cams 15 in response to pivoting of the plate 11 by the yoke 10. The plate 11 transmits motion to the flap 13 during pivoting toward or away from its starting position. The axis of the hinge 12 is preferably normal to the planes of the sidewalls 7, 8 and is parallel to the upper side of the bottom wall 2. When the yoke 10 maintains the plate 11 in the starting position of FIGS. 1 and 2, the flap 13 extends downwardly from the hinge 12 under the action of gravity but the exact orientation of the flap depends on the configuration of the upper portions a of the cams 15 which upper portions a then receive the respective followers 14 of the flap 13. The upper portions a of the cams 15 are or can be substantially normal to the plane of the bottom wall 2, and the lower portions b of such cams are or can be substantially parallel to the upper side of the bottom wall 2 so that the lower marginal portion 17 of the flap 13 is guided in a direction away from the outlet 6 during the second or last stage of pivotal movement of the plate 11 along its path (about the shaft or shafts 9) in one of the directions indicated by the double-headed arrow 16.

The grooves (including the portions a and b of the cams 15 can be machined into or are otherwise formed in the sidewalls 7 and 8; alternatively, such cams can be affixed (e.g., riveted or bolted) to the inner sides of the respective sidewalls forming part of the first crushing unit 1.

The operation of the apparatus of FIGS. 1 and 2 is as follows:

The handle 10' is manipulated to pivot the yoke 10 in a counterclockwise direction so as to move the two sections 11, 13 of the second crushing unit to the starting positions of FIGS. 1 and 2. The compartment 4 is then readily accessible for introduction of a can 3 which is to be crushed in response to pivoting of the yoke 10 from the position of FIG. 2, through the intermediate position of FIG. 2*a* and (preferably) all the way to the position of FIG. 2*b*. The can 3 is introduced at 5 with its end wall 18 leading. The uppermost portion of the end wall 18 can come close to or actually engages the underside of the plate 11 (as at 19) when the insertion of the can 3 into the compartment 4 is completed. The axis of the can 3 is then parallel to the planes of the sidewalls 7, 8 and to the bottom wall 2. The preferably rounded marginal portion 17 at the lowermost point of the flap 13 is then adjacent the peripheral wall 19*a* of the properly inserted can 3 and is parallel or substantially parallel to the plane of the end wall 18. For example, the marginal portion 17 of the flap 13 can engage the peripheral wall 19*a* of the properly inserted can 3 midway or substantially midway between the end wall 18 and the other end wall (if any) of the can. If desired, the marginal portion 17 can be constituted by an elongated small-diameter roller (not specifically shown) which is journalled in the flap 13 between its followers 17. This further reduces the magnitude of the force which is required to crush the can 3 in the compartment 4.

Figure 2A:
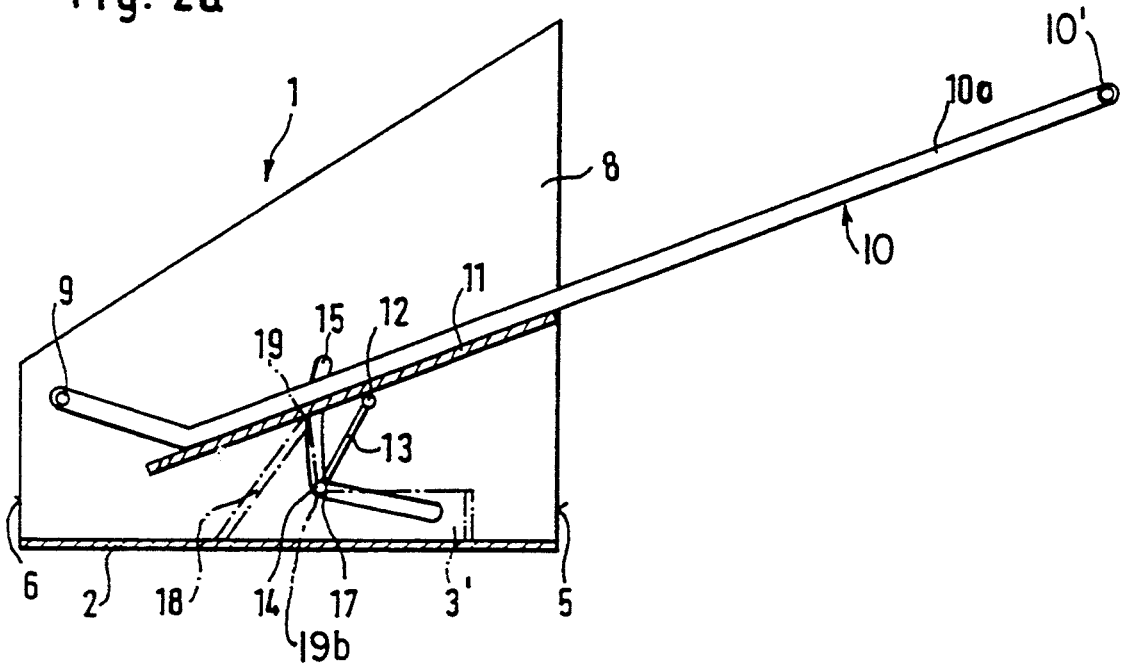
FIG. 2*a* illustrates the structure of FIG. 2 but with the second crushing unit in an intermediate position.
Figure 2B:
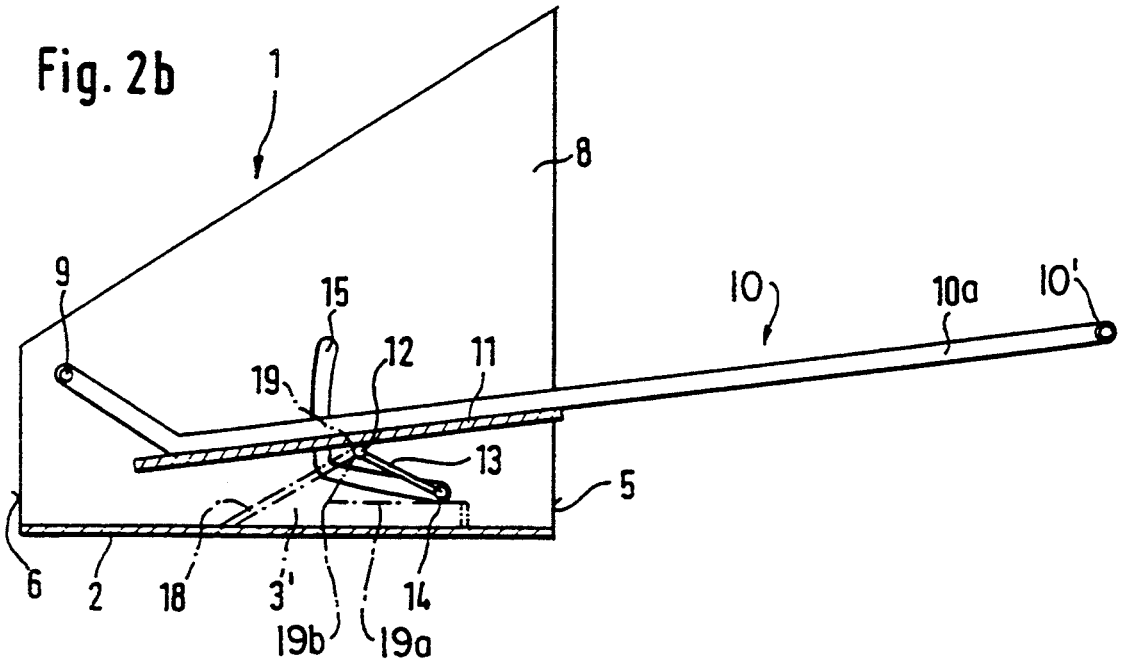
FIG. 2*b* illustrates the structure of FIG. 2 but with the second crushing unit located in a different position at a greater distance from the position of FIG. 2.

The operator in charge (e.g., a housewife or an employee in a restaurant, bar, kitchen in a military post, a school kitchen or any other establishment which is likely to use a substantial number of metallic or plastic cans) thereupon applies to the handle 10' a force in the direction of arrow P (FIG. 2) to pivot the yoke 10 from the starting position of FIGS. 1–2, through the intermediate position of FIG. 2*a* and to the lowermost or end position of FIG. 2*b*. The legs 10*a*, 10*b* of the yoke 10 move along a circular path around the axis which is defined by the shaft or shafts 9, and the plate 11 transmits motion to the flap 13 for movement along the path which is determined by the cams 15. Such movement results in advancement of the marginal portion 17 of the flap 13 against the topmost portion of the peripheral wall 19*a* of the can 3 in the compartment 4 whereby the marginal portion 17 provides the wall 19*a* with a fold line 19*b* (FIG. 2*a*) which extends in substantial parallelism with the pivot axis of the legs 10*a*, 10*b* as defined by the shaft or shafts 9. If the peripheral wall 19*a* has a square or rectangular outline and one of its four exposed sides lies against the upper side of the bottom wall 2, the marginal portion 17 engages and deforms the entire upper side of such polygonal peripheral wall 19*a* and provides it with a fold line 19*b* extending in parallelism with the axis of the hinge 12.

The end wall 18 of the can 3 in the compartment 4 is engaged by the plate 11 at the time the plate 11 is still maintained in the starting position of FIGS. 1–2 or shortly or immediately after the yoke 10 begins to pivot toward the position of FIG. 2*a*. This causes the underside of the plate 11 to bear against and to tilt the end wall 18 about the fold line 19*a* toward and over the upper portion of the peripheral wall 19*a* of the can. In other words, the topmost portion of the end wall 18 is caused to move toward the inlet 5. Such movement of the plate 13 results in a predetermined crushing of the can 3 in the compartment 4, i.e., the peripheral wall 19*a* is depressed by the marginal portion 17 of the flap 13 to form the fold line 19*b*, and the plate 13 deforms the can (simultaneously or immediately thereafter) in a direction to move the topmost portion of the end wall 18 toward the inlet 5 to thus convert the can into a relatively flat package. The initial inclination of the underside of the plate 13 (in the starting position of FIGS. 1 and 2) can be sufficiently pronounced to ensure that the topmost part of the end wall 18 will slide along the plate 13 as the latter applies a force in a direction substantially at right angles to the upper side of the bottom wall 2.

The initial deformation of the peripheral wall 19*a* under the action of the marginal portion 17 of the flap 13 can be within the elastic limits of the material of the can. However, such deformation becomes permanent after the marginal portion 17 covers a certain distance in a direction toward the bottom wall 2, i.e., the fold line 19*b* becomes permanent and defines an axis for further pivoting of the end wall 18 from the substantially vertical plane which is shown in FIGS. 1 and 2 (it being assumed that the bottom wall 2 is located in a substantially horizontal plane) toward the plane of FIG. 2*a* and ultimately to the plane of FIG. 2*b*, i.e., into planes making acute angles with the upper side of the bottom wall 2.

The force acting (at 19) upon the topmost portion of the end wall 18 in response to downward movement of the flap 13 simultaneously with pivoting of the plate 11 has a component in a direction toward the inlet 5. The marginal portion 17 actually pulls the topmost portion of the end wall 18 in a direction away from the outlet 6 even before the plate 11 begins to tilt the end wall 18 from the vertical plane of FIG. 2 toward the plane of FIG. 2*a*. All this results in a flattening of the can 3 in the compartment 4, first as a result of application of a force (by marginal portion 17) against the peripheral wall 19*a* to form the fold line 19*b* and thereupon as a result of tilting of the end wall 18 about the fold line 19*b*.

The marginal portion 17 begins to move between the downwardly and rearwardly sloping portions b of the cams 15 during the last stage of pivoting of the plate 11 toward the position of FIG. 2*b* whereby the marginal portion 17 moves out of the way (namely from the fold line 19*b* toward the inlet 5) to provide room for the end wall 18 which is being folded over the collapsed peripheral wall 19*a*, namely about an axis coinciding with or being close to the fold line 19*b*. The portions a of the cams 15 are or can be substantially normal to the plane of the bottom wall 2, and the portions b of such cams make with the upper side of the bottom wall 2 relatively small acute angles. This ensures that the marginal portion 17 does not interfere with pivotal movement of the end wall 18 from the position of FIG. 2 all the way to the position of FIG. 2*b*. The arrangement can be such that the end wall 18 is substantially parallel with the bottom wall 2, and that the peripheral wall 19*a* is flattened into a thin package between the bottom wall 2 and the fully tilted end wall 18 when the crushing of a can 3 in the compartment 4 is completed. In other words the crushing can proceed beyond the stage which is shown in FIG. 2*b*.

The handle 10' is thereupon moved back to the starting position of FIGS. 1–2 and the crushed can 3' can be evacuated through the inlet 5 or through the outlet 6, depending upon the selected inclination of the bottom wall 2.

Figure 4:
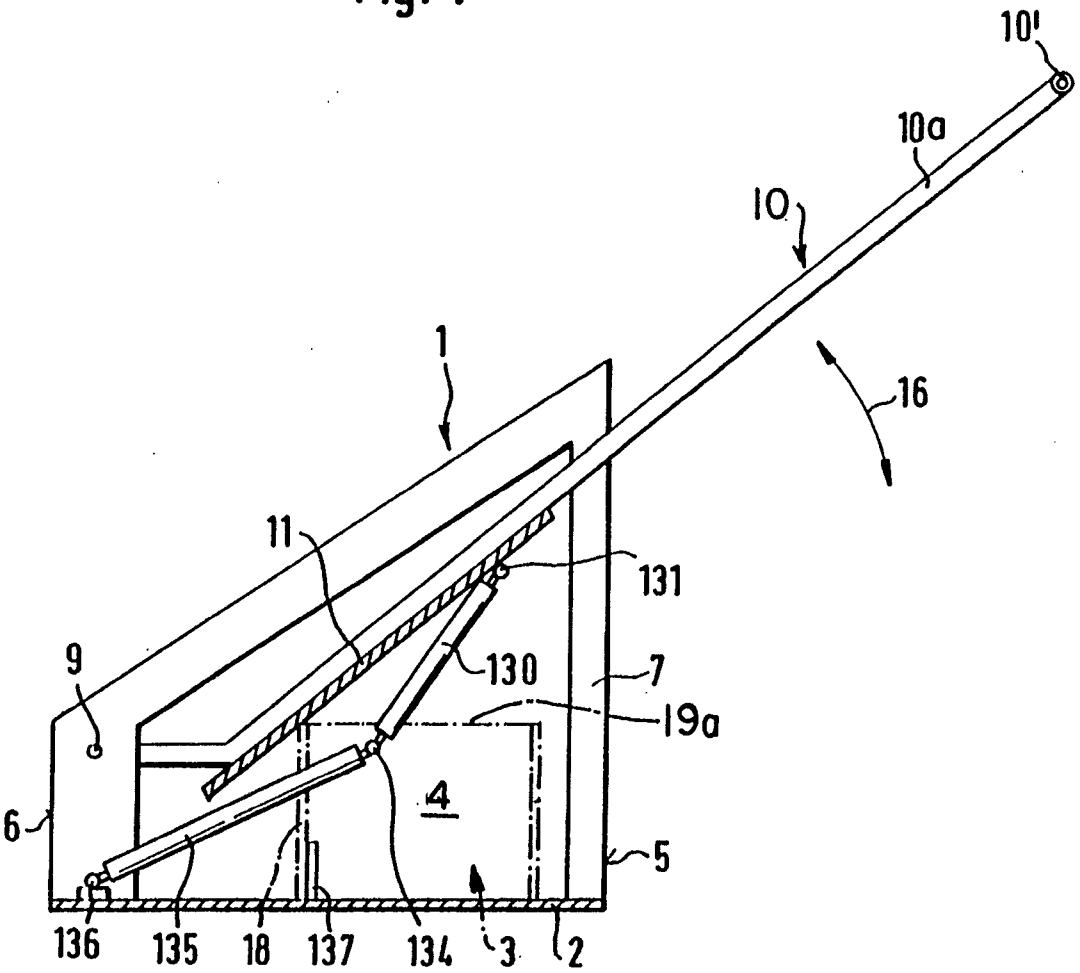
FIG. 4 is a sectional view substantially as seen in the direction of arrows from the line IV—IV in FIG. 3.
Figure 3:
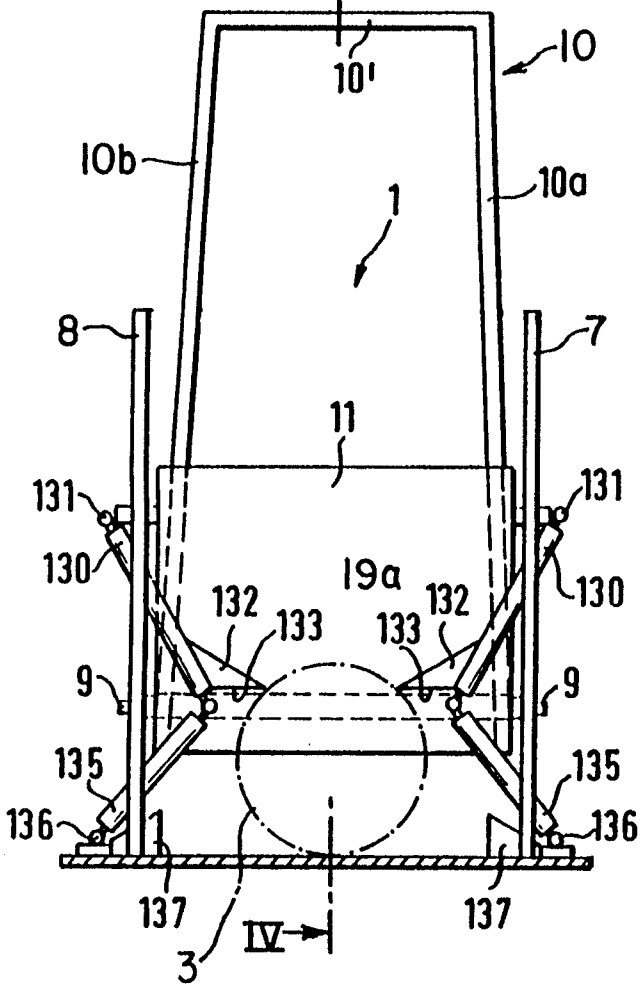
FIG. 3 is a view similar to that of FIG. 1 but showing an apparatus employing a modified second crushing unit.

The apparatus of FIGS. 3 and 4 differs from the apparatus of FIGS. 1–2*b* primarily in the construction and mode of operation of the second crushing unit including the aforediscussed plate 11 and a modified section serving to deform the peripheral wall 19*a* of a can 3 in the compartment 4. All such parts of the second apparatus which are identical with or clearly analogous to corresponding parts of the apparatus of FIGS. 1–2*b* are denoted by similar reference characters.

The sidewalls 7, 8 resemble or constitute frames, i.e., they are not solid plates. In other words, each sidewall has at least one window which permits observation of the plate 11 and of the other (first) section of the second crushing unit and further serves an additional purpose. Such other section comprises two links 130 having upper end portions which are movably connected to the plate 11 by universal joints 131 and lower end portions carrying relatively small plate-like folding or crushing elements 132. The arrangement is such that, instead of moving toward the inlet 5 (note the cam portions b in the apparatus of FIGS. 1–2*b*), the elements 132 (which perform the function of the marginal portion 17 of the flap 13) are caused to move sideways and outwardly through the windows of the respective sidewalls 7, 8 so that such elements cannot interfere with tilting of the end wall 18 of a partially collapsed can 3 in the compartment 4 over the at least partially collapsed peripheral wall 19*a* of such can. The links 130 and their elements 132 are mirror images of each other with reference to a plane which is normal to the axis defined by the shaft or shafts 9, such plane being located midway between the links 130.

The universal joints 131 are also located outside of the space between the sidewalls 7, 8 and the lower end portions of the links 130 are coupled to additional universal joints 134 which connect them to additional links 135 forming part of means for connecting the links 130 to the first crushing unit 1. Such connecting means further include substantially wedge-shaped guides 137 on the bottom wall 2 of the unit 1 and universal joints 136 provided on the lower end portions of the additional links 135 adjacent the respective guides 137 and connected to the bottom wall 2.

The undersides 133 of the crushing elements 132 are located in a common plane and are aligned with each other; they serve to provide the peripheral wall 19*a* of a can 3 in the compartment 4 with a fold line when the handle 10' is pivoted from the starting position of FIGS. 3 and 4 to move the plate 11 along an arcuate path about the pivot axis for the legs 10*a*, 10*b* whereby the plate 11 moves the links 130 and their crushing elements 132 along predetermined paths to thereby crush a can 3 substantially in the same way as described in connection with FIGS. 2*a* and 2*b*.

The manner of introducing a can 3 into and of orienting the introduced can in the compartment 4 is or can be the same as described with reference to FIGS. 1–2*b*. As the handle 10' pivots the plate 11, the lower edge portions 133 of the crushing elements 132 engage and deform the peripheral wall 19*a* of the properly inserted can 3 to establish a fold line for tilting of the end wall 18 by the plate 11. The links 130 reach and are guided by the guides 137 outwardly and away from the path of the end wall 18 during the last stage of pivoting of the second crushing unit including the plate 11 and the links 130. The elements 132 are also pivoted out of the way to thus ensure that the plate 11 can tilt the end wall 18 in the aforedescribed manner, namely to convert the can 3 into a relatively thin package wherein the crushed peripheral wall 19*a* is overlapped by the tilted end wall 18.

If a can 3 comprises a second end wall or cover opposite the end wall 18 (e.g., because the evacuation of the contents of the can took place by way of one or more holes in the cover), the crushing of such can can be carried out in two successive steps. Thus, the end wall 18 will be tilted and the peripheral wall 19*a* will be crushed in a manner as described above in connection with FIGS. 1–2*b* or in connection with FIGS. 3–4, and the handle 10' is then pivoted back to the starting position. The partially crushed can 3' is removed from the compartment 4, turned through 180 degrees and reinserted into the compartment 4 so that the cover faces the outlet 6. The crushing operation is then repeated with the exception that the cover is titled over the adjacent portion of the crushed peripheral wall 19*a* and/or over the previously tilted end wall 18.

An important advantage of the improved apparatus is that a can can be crushed with the exertion of a relatively small force. This is due to the provision of the fold line 19*b* which permits ready tilting of the end wall 18 (or cover) over the at least partially collapsed peripheral wall 19*a* of the can in the compartment 4. Moreover, the section 13 (or the corresponding section including the links 130 and their elements 132) is moved away from the path of an end wall 18 during the last stage of a crushing operation so that the tilting of the end wall or cover to the position corresponding to that of the end wall 18 shown in FIG. 2*b* (or even beyond such position) does not require the application of a substantial force.

Another important advantage of the improved apparatus is its simplicity which contributes to compactness and low cost. This renders it possible to install the improved apparatus in numerous establishments wherein the space is at a premium but a simple and efficient apparatus for crushing empty or at least partially emptied cans contributes to a reduction of space requirements for garbage in the establishment as well as at the garbage dump.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. Apparatus for crushing tubular containers of the type having a peripheral wall constituting a first portion and an end wall constituting a second portion thereof, comprising a container-supporting first crushing unit; a second crushing unit movable with reference to the first crushing unit from a starting position in which said units define a compartment for a container to be crushed, said first unit including a support having a bottom wall adjacent to and disposed beneath said compartment and said bottom wall having an upper side which supports the first portion of a container in said compartment, said second unit comprising a first section engageable with the first portion of a container in said compartment and a second section engageable with the second portion of the container in said compartment; means for moving said second unit from and back to said starting position, said sections being disposed above said bottom wall and moving toward said bottom wall in response to movement of said second unit from said starting position, said moving means including a device for moving said second section during a first stage of movement of said second unit from said starting position and for moving said first section during a second stage of movement of said second unit from said starting position not later than during said first stage, said device including a carrier and means for pivotably connecting said carrier to said support, at least one of said sections being mounted directly on said carrier; and means for guiding said first and second sections along first and second paths, respectively, in response to movement of said second unit from said starting position to thereby deform the first and second portions of the container in said compartment, said first path being configurated to cause said first section to impart to the first portion of the container in said compartment a fold line for pivoting of the second portion of the container in said compartment along the fold line in response to movement of the second section of the second unit along said second path, said first path including a first portion wherein said first section moves toward the bottom wall of said support and a second portion wherein said first section moves away from said second path, said first section moving along said first portion and thereupon along said second portion of said first path in response to movement of said second unit from said starting position.

2. The apparatus of claim 1, wherein said second portion of said first path is configurated to move said first section away from the fold line to thus provide room for pivoting of the second portion of the container in said compartment over the first portion along the fold line in response to movement of the second section along said second path.

3. The apparatus of claim 1, wherein said support further comprises two upstanding sidewalls flanking said compartment, said device including a substantially U-shaped yoke having a web remote from said compartment and two legs having end portions remote from said web and each pivotably mounted in a different one of said sidewalls.

4. The apparatus of claim 3, wherein said web constitutes a handgrip portion of said moving means.

5. The apparatus of claim 1, wherein said second section includes a plate and said device comprises means for pivoting said plate relative to said first unit, said first section comprising a flap and a hinge connecting said flap to said plate.

6. The apparatus of claim 1, wherein one of said sections movably supports and transmits motion to the other of said sections in response to movement of said second unit to and from said starting position.

7. Apparatus for crushing containers comprising a container-supporting first crushing unit; a second crushing unit movable with reference to the first unit from a starting position in which said units define a compartment for a container to be crushed, said second unit comprising a first section engageable with a first portion of a container in said compartment and a second section engageable with a second portion of the container in said compartment; means for moving said second unit from and back to said starting position, said second section comprising a plate and said moving means comprising means for pivoting said plate relative to said first unit, said first section comprising first and second links and hinges movably connecting said links to said plate; and means for guiding said first and second sections along first and second paths, respectively, in response to movement of said second unit from said starting position to thereby deform the first and second portions of the container in said compartment.

8. The apparatus of claim 7, wherein said moving means comprises a handle and means for pivotably connecting said handle to said first unit for movement about a substantially horizontal axis, said links being mirror images of each other with reference to a plane which is normal to said axis and is located between said links.

9. The apparatus of claim 7, further comprising means for movably connecting said links to said first unit.

10. The apparatus of claim 9, wherein said connecting means comprises guides on said first unit, an additional link for each of said first and second links, a hinge connecting each additional link to the respective one of said first and second links, and a universal joint provided on each additional link and connected to said first unit.

* * * * *